US006657846B1

(12) United States Patent
Philipp et al.

(10) Patent No.: US 6,657,846 B1
(45) Date of Patent: Dec. 2, 2003

(54) ELECTROMAGNETIC INJECTION VALVE

(75) Inventors: Matthias Philipp, Vaihingen/Enz (DE); Bernd Herrmann, Sachsenheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/530,674

(22) PCT Filed: Aug. 28, 1999

(86) PCT No.: PCT/DE99/02699

§ 371 (c)(1),
(2), (4) Date: Jul. 26, 2000

(87) PCT Pub. No.: WO00/14395

PCT Pub. Date: Mar. 16, 2000

(30) Foreign Application Priority Data

Sep. 2, 1998 (DE) ..... 198 39 863

(51) Int. Cl.[7] ..... H01H 47/00
(52) U.S. Cl. ..... 361/160; 361/156; 123/490
(58) Field of Search ..... 361/156, 160; 123/490

(56) References Cited

U.S. PATENT DOCUMENTS 3,942,485 A 3/1976 Inui et al.
4,688,138 A 8/1987 Nagata et al.
5,291,170 A 3/1994 Wahba et al.
5,363,270 A 11/1994 Wahba et al.
5,574,617 A 11/1996 Shimanuki et al.

FOREIGN PATENT DOCUMENTS

DE 2 306 007 9/1973
DE 198 03 567 8/1999

*Primary Examiner*—Greory J. Toatley, Jr.
*Assistant Examiner*—Isabel Rodriguez
(74) *Attorney, Agent, or Firm*—Kenyon & Kenyon

(57) ABSTRACT

An electromagnetic injection valve is proposed. The electromagnetic valve includes two magnetic coils that are wound in opposite directions and have the same characteristics on the same magnetic circuit, causing the forces of the magnetic coils to cancel each other out at the same excitation current. The two magnetic coils with canceling effect transforms the actual turn-on action of the valve, i.e., the opening of, the valve, into a turn-off action in one of the two coils. A rapid current drop is then determined by an extinction voltage. This makes it possible to achieve rapid force increase times without increasing the supply voltage. The valve can be controlled with a conventional switching output stage or with a current-regulated switching output stage. Reversing a differential current at turn-off also makes it possible to shorten the closing action.

17 Claims, 2 Drawing Sheets

ELECTROMAGNETIC INJECTION VALVE

FIELD OF THE INVENTION

The present invention relates to an electromagnetic injection valve having a double coil, in which a first and a second magnetic coil having the same characteristics are arranged on the same magnetic circuit, with one end of each magnetic coil being connected to the same supply voltage and the other end connected to a first and a second switching means, respectively, of an electronic drive circuit, and a holding circuit controllable by the drive circuit being parallel-connected to the first magnetic coil.

BACKGROUND INFORMATION

A conventional electromagnetic injection valve is described in Unexamined German Patent Application No. 2 306 007. In the conventional electromagnetic injection valve, two or more magnetic coils on the same magnetic circuit and an electronic drive mechanism functionally adapted to this arrangement are used to open and close the shutoff element of the injection valve by generating an electromagnetic attraction force opening the shutoff element from its closed state via a first excitation, generating an electromagnetic attraction force holding the shutoff element in its open state once it has been opened through a second excitation, and finally generating an opposite magnetic flux through a third excitation, thereby extinguishing the induced magnetic flux and closing the shutoff element from its open state.

As a general rule, the current increase in an electromagnetic injection valve, and thus also the force increase in an armature, is largely determined by the inductance and resistance of the valve coil and supply voltage Ubatt of the coil. The inductance is derived from the number of coil windings and the design of the magnetic circuit. In motor vehicles, the supply voltage is limited to 12 volts. Today's turn-on time requirements for an electromagnetic injection valve used in a motor vehicle have led, in single valve coils, to very high currents that cannot be achieved with present switching transistors and existing line resistance values.

Up to now, the fast increase in current and force needed in the injection valve at turn-on has been achieved with a higher voltage from a booster capacitor that is charged by a d.c.-d.c. converter or by recharging. The d.c.-d.c. converter is needed in magnetic circuits with high eddy-current losses because recharging with the valve inductance is too inefficient in this case. In addition, recharging with the valve would lead to excessively long booster capacitor charging times. The recharging current excites the magnetic circuit, thus reducing protection against leakage and unwanted valve opening.

SUMMARY OF THE INVENTION

An object of the present invention is to provide a reliable electromagnetically operated injection valve with the shortest possible turn-on and turn-off times and simple circuitry.

In an electromagnetic injection valve according to the present invention, the object is achieved by winding the two magnetic coils in opposite directions so that their forces cancel each other out if the same excitation current flows through them, and by the drive circuit controlling the switching means during one complete open-hold-close cycle of the valve so that during a first phase, an initial charging action occurs while the valve is closed, with both switching means being closed while the holding circuit is inactive, and the current flowing through the two magnetic coils rising at a relatively slow rate;

during a second phase, which is a valve opening phase, the current flowing through the second magnetic coil is quickly turned off as the second switching means opens, while the first switching means remains closed and the holding circuit remains inactive;

during a third phase, which is a holding phase, the holding circuit is activated, causing the current flowing through the first magnetic coil to drop to a holding current intensity; and during a fourth phase, which is a closing phase, the valve is closed by at least deactivating the holding circuit and opening the first switching means.

The canceling action of the double coil transforms the actual valve activation, i.e., the valve opening action, into a turn-off action in one of the two coils in the second phase. The rapid current drop is then determined by dimensioning the extinction voltage. Rapid force rising times can therefore be achieved without increasing the supply voltage. The injection valve can be controlled by a conventional switching output stage or by a current-regulated switching output stage. Reversing the differential current at turn-off also makes it possible to shorten the closing action. One important advantage of the present invention is therefore the ability to simplify and reduce the cost of the output stage. No booster capacitor or d.c.-d.c. converter is needed in the control unit. As a result, it is also possible to easily integrate the output stage into the control unit.

DETAILED DESCRIPTION

Figure 1:
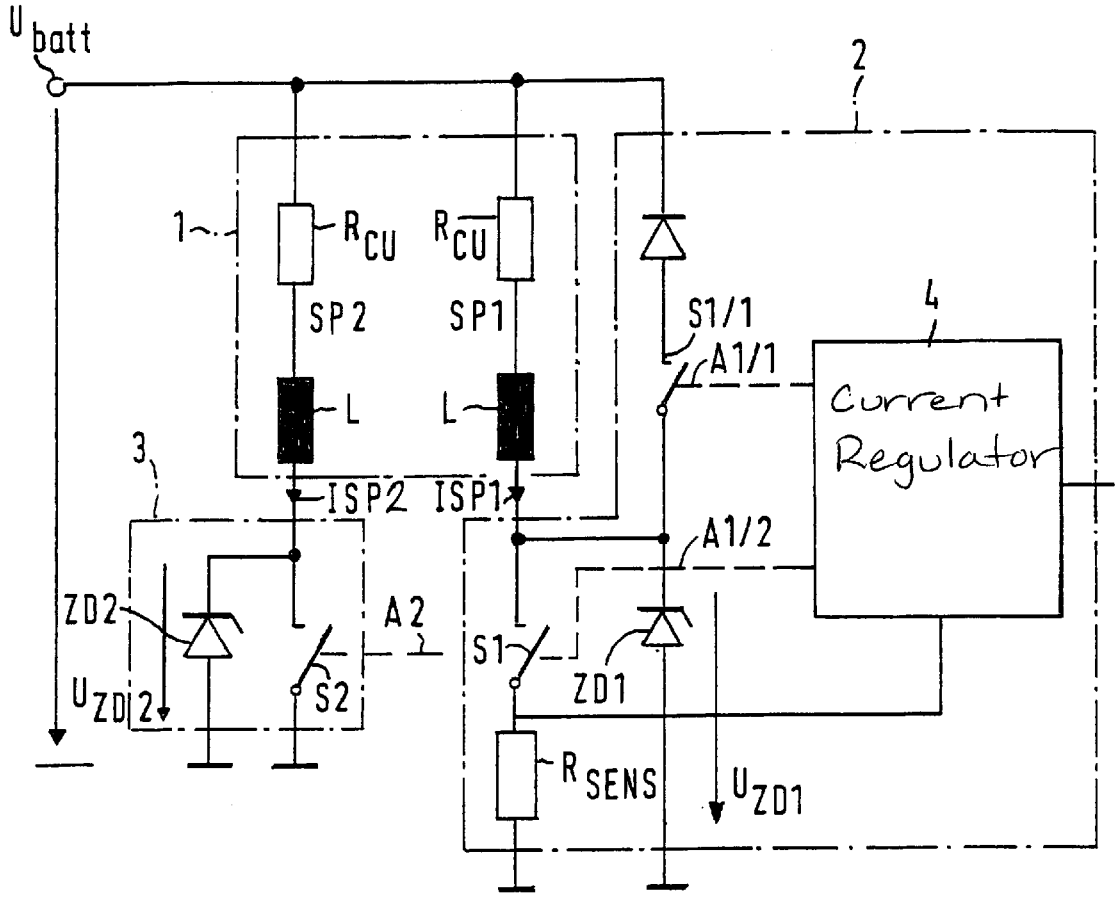
FIG. 1 shows a block diagram of a circuit of an electromagnetic injection valve having a double coil in conjunction with output stages of a drive circuit.

In the circuit illustrated in FIG. 1, reference number 1 designates an equivalent circuit of an electromagnetic injection valve having a double coil. The magnetic circuit of injection valve 1 thus includes two magnetic coils SP1 and SP2 wound in opposite directions. Both magnetic coils SP1, SP2 have the same characteristics, i.e., number of windings, inductance L, and winding resistance $R_{cu}$, and their forces cancel each other out if the same current ISP1, ISP2 flows through them due to the opposite winding directions. One end of each magnetic coil SP1 and SP2 is connected to the same supply voltage, e.g., Ubatt=12 volts in motor vehicles. A first switching means S1, which is represented symbolically as a single controllable switch, is connected in series to first magnetic coil SP1, assigned to a current-regulated switching output stage 2, and opened and closed by a control pulse A1/2 from switching output stage 2. The circuit of first magnetic coil SP1 also includes a current measuring element which, in FIG. 1, is a resistor $R_{sens}$ that is connected in series to switching means S1. The with the voltage drop at resistor $R_{sens}$ is proportional to current ISP1 in the circuit of first magnetic coil SP1 flowing through resistor $R_{sens}$.

A first extinction means, e.g., in the form of a Zener diode ZD1 with a Zener voltage $U_{ZD1}$, is connected in parallel to first switching means S1 and current measuring element $R_{sens}$. Alternatively, an RC extinction arrangement may be provided. First extinction means ZD1 is used to quickly turn off current ISP1 flowing through first magnetic coil SP1, as explained in greater detail below. In addition, a holding circuit composed of a switching means S1/1 that can be opened and closed by a control pulse A1/1 from current-regulated switching output stage 2 and a diode, is connected in parallel to first magnetic coil SP1 and used to hold the injection valve in its open state while first switching means S1 is open, as explained in greater detail below.

Also connected in series to second magnetic coil SP2 is a second switching means S2 that can be opened and closed by a control pulse A2 and is parallel-connected to a second extinction means in the form of a Zener diode ZD2. Second switching means S2 is operated by an unregulated single switching output stage 3. Zener diode ZD2, which is connected in parallel to second switching means S2 and used as a second extinction means, is used to quickly turn off current ISP2 flowing through second magnetic coil SP2, as explained below.

As an alternative to the circuit embodiment illustrated in FIG. 1, it is also possible to operate double-coil injection valve 1 in other embodiments having two single switching output stages and no current regulation. In this case, however, the current drop in the holding phase described below is not possible.

Figure 2:
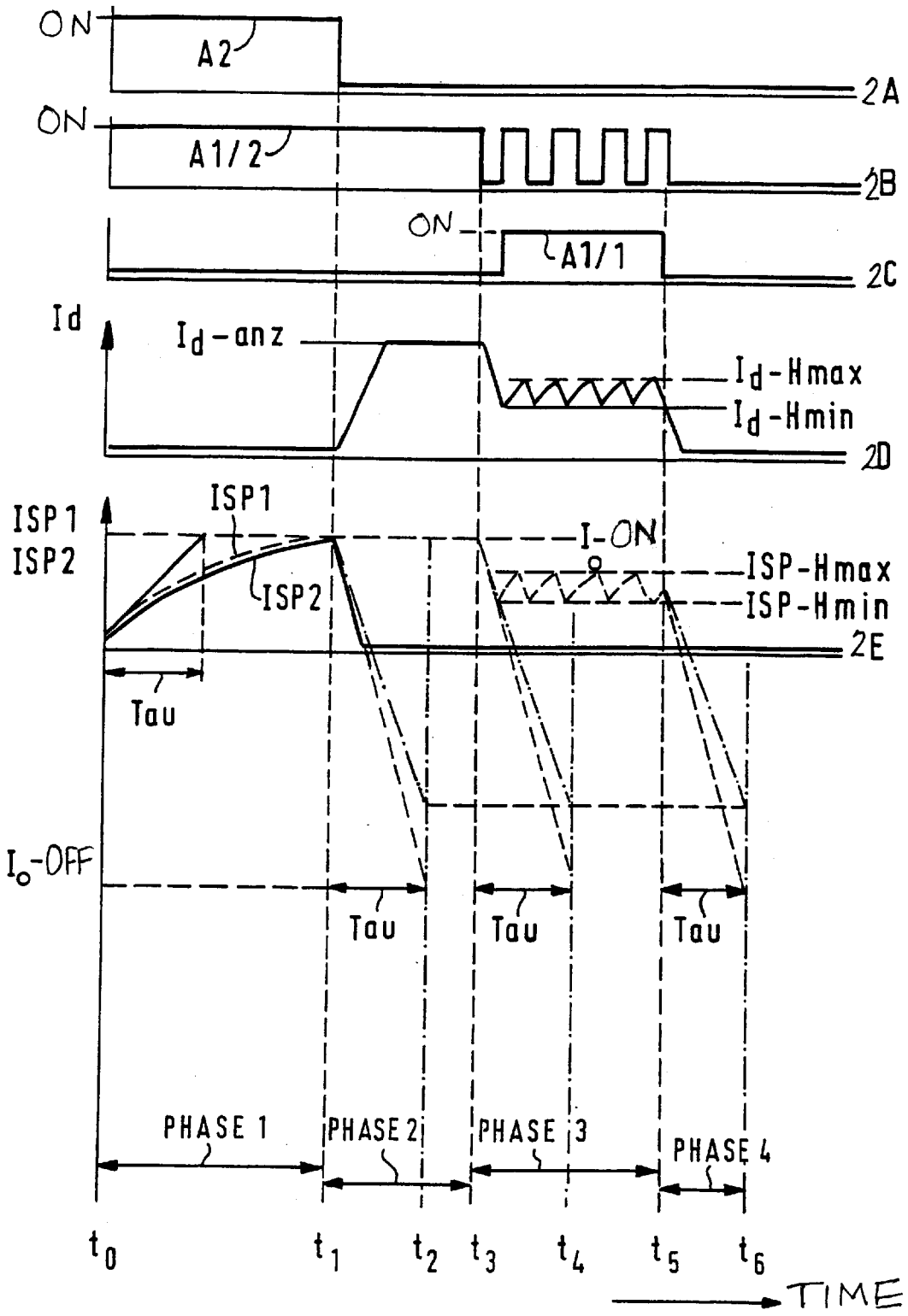
FIG. 2A shows a signal variation over time of control pulse A2 for the second switching means shown in FIG. 1.
FIG. 2B shows a signal variation over time of control pulse A1 for the first switching means shown in FIG. 1.
FIG. 2C shows a signal variation over time of control pulse A1/1 for the holding circuit shown in FIG. 1.
FIG. 2D shows a signal variation over time of a differential current of the currents flowing through the first magnetic coil and the second magnetic coil shown in FIG. 1.
FIG. 2E shows a signal variation over time of individual currents flowing through the first magnetic coil and the second magnetic coil shown in FIG. 1.

The function and operation of the circuit according to the present invention described above and illustrated in FIG. 1 for the electromagnetic double-coil injection valve are explained below on the basis of the signal timing diagram shown in FIG. 2. FIGS. 2A–2E show the variations over time of: control pulse A2 for the second switching means (FIG. 2A); control pulse A1/2 for first switching means S1 (FIG. 2B); control pulse A1/1 for the holding circuit (FIG. 2C); differential current Id=ISP1−ISP2 of the currents flowing through first and second magnetic coils SP1 and SP2 (FIG. 2D); and individual currents ISP1, ISP2 flowing through first and second magnetic coils SP1 and SP2, over one complete open-hold-close cycle divided into four phases—Phase 1, Phase 2, Phase 3, and Phase 4—from a time t0 to a time t6. The description below follows a sequence from Phase 1 to Phase 4.

Charging, Phase 1; t0–t1:

At time t0, both switching means S1, S2 are or have been turned on; A2 and A1/2 are on (FIGS. 2*a* and 2B). Currents ISP1, ISP2 rise at a relatively slow rate (FIG. 2E). Maximum current $I_0$-ON=Ubatt/$R_{cu}$ is lower at Ubatt=12 volts than $I_0$-OFF at turn-off in Phase 2. Both coils SP1, SP2, i.e., both switching means S1, S2, must therefore be turned on relatively early prior to the actual opening of valve 1. The current during this phase can be controlled by selecting a suitable closing time prior to Phase 2 (opening time t1). An alternative is to regulate the current in both coils SP1, SP2. Time constant Tau−L/$R_{cu}$ indicates the rate of current rise at time t0. The identical characteristics and opposite winding directions of both magnetic coils SP1, SP2 yield differential current Id=ISP1−ISP2=0 (FIG. 2D).

Valve Opening, Phase 2; t1–t3:

At the start at time t1, current ISP2 is quickly turned off by the extinction action of second Zener diode ZD2 as S2 is opened by single switching output stage 3 due to A2=OFF (FIG. 2A). The current gradient during turn-off at time t1 is determined by $I_O$-OFF=$U_{ZD2}$/$R_{cu}$ and Tau=L/$R_{cu}$. With a correspondingly high extinction voltage $U_{ZD2}$ of Zener diode ZD2, this current gradient is much higher than at turn-on. Current ISP1 flowing through magnetic coil SP1 remains at inrush current level $I_O$-ON. Alternatively, this can also be accomplished by current regulation (see FIG. 2E). The force increase in the valve is proportional to the square of differential current Id=ISP1−ISP2 and therefore very fast (short turn-on time).

Holding phase 3 with open valve; t3–t5:

During the holding phase, differential current Id (FIG. 2D) is reduced to the holding current level at magnetic coil SP1 by current-regulated switching output stage 2, which includes current regulator 4, and regulated between Id−Hmax and Id−Hmin by the current regulating arrangement. S1 is turned off by control pulse A1/2 with current extinction by first Zener diode ZD1. In this case as well, a correspondingly high Zener voltage $U_{ZD1}$ accelerates extinction and thus the turn-off action of current ISP1. To maintain the holding current level, the holding circuit, i.e., switching means S1/1, is closed by control pulse A1/1 (FIG. 2C), and S1 is intermittently opened and closed (FIG. 2B). Holding current ISP1-H is regulated between ISP1-Hmax and ISP1-Hmin during Phase 3.

Valve Closing; Phase 4, t5–t6:

To close the valve, either only current ISP1 flowing through magnetic coil SP1 is turned off or, to support the closing action with even shorter turn-off times, current ISP1 flowing through coil SP1 is turned off by simultaneously briefly turning on current ISP2 flowing through magnetic coil SP2, which is not illustrated in FIGS. 2A–2E. Doing so reverses differential current Id and thus the force.

FIGS. 2A–2E also shows, in Phases 2, 3, and 4, the high negative current gradients that can be achieved with the features according to the present invention, with these gradients symbolized by time constants Tau shown in the figures.

The double magnetic coil with a canceling effect according to the present invention transforms the actual turn-on action of the electromagnetic injection valve, i.e., opening the valve during Phase 2, into a turn-off action in one of the two magnetic coils. The rapid current drop is determined by the extinction voltage. Rapid force increase times can thus be achieved without actions that increase the supply voltage. The electromagnetic injection valve can be controlled with either a conventional switching output stage or, as in the embodiment described above, with a current-regulated switching output stage. Reversing differential current Id at turn-off in Phase 4 also makes it possible to shorten the closing action.

Therefore, one important advantage of the present invention is the ability to simplify the output stage. No booster capacitor or d.c.-d.c. converter has to be provided in the control unit. This makes it easier to integrate the output stage into the control unit.

What is claimed is:

1. An electromagnetic injection valve having a double coil, comprising:

a magnetic circuit;

a first magnetic coil arranged in the magnetic circuit;

a second magnetic coil arranged in the magnetic circuit, the first magnetic coil and the second magnetic coil having the same characteristics, the first magnetic coil and the second magnetic coil being would in opposite directions so that a first force of the first magnetic coil and a second force of the second magnetic coil cancel each other out if a same excitation current flows through the first magnetic coil and the second magnetic coil;

a supply voltage connected to a first end of each of the first magnetic coil and the second magnetic coil;

an electronic drive circuit having a first switching device and a second switching device, the first switching device being connected to a second end of the first magnetic coil, the second switching device being connected to a second end of the second magnetic coil; and a holding circuit connected in parallel to the first magnetic coil, the holding circuit being controllable by the electronic drive circuit, wherein:

the electronic drive circuit controls the first switching device and the second switching device during one complete open-hold-close cycle of the electromagnetic injection valve so that:

during a first phase, an initial charging action occurs while the electromagnetic injection valve is closed, the first switching device and the second switching device being closed while the holding circuit is inactive, a first current flowing through the first magnetic coil and a second current flowing through the second magnetic coil rising at a relatively slow rate;

during a second phase, the second current is quickly turned off as the second switching device opens, the first switching device remaining closed and the holding circuit remaining inactive, the second phase being a valve opening phase;

during a third phase, the holding circuit is activated causing the first current to drop to a holding current intensity, the third phase being a holding phase; and during a fourth phase, the electromagnetic injection valve is closed by at least deactivating the holding circuit and opening the first switching device, the fourth phase being a closing phase.

2. The valve according to claim 1, wherein:

the electronic drive circuit sets the first current and the second current during the first phase by determining a closing time of the first switching device and the second switching device.

3. The valve according to claim 1, wherein:

the electronic drive circuit sets a first current intensity flowing through the first magnetic coil and a second current intensity flowing through the second magnetic coil by regulating the first current and the second current during the first phase.

4. The valve according to claim 1, further comprising:

a first extinction device connected in parallel to the first switching device, the first extinction device increasing a current gradient when the first current is turned off by the first switching means.

5. The valve according to claim 4, wherein:

the first extinction device includes a zener diode.

6. The valve according to claim 1, further comprising:

a second extinction device connected in parallel to the second switching device, the second extinction device increasing a current gradient when the second current is turned off by the second switching means accelerating the opening of the valve at the beginning of the second phase.

7. The valve according to claim 6, wherein:

the second extinction device includes a zener diode.

8. The valve according to claim 1, further comprising:

a current measuring element arranged in a circuit of the first magnetic coil;

a current regulator connected to the current measuring element to regulate at least the first current, the electronic drive circuit including the current regulator.

9. The valve according to claim 8, wherein:

the current measuring element includes a resistor connected in series to the first switching device.

10. The valve according to claim 8, wherein:

the current regulator regulates the first current during the second phase.

11. The valve according to claim 1, wherein:

the current regulator regulates the first current between a minimum holding current and a maximum holding current during the holding phase by intermittently activating and deactivating the holding circuit while the first switching device is closed.

12. The valve according to claim 1, wherein:

at the beginning of the fourth phase, the electronic drive circuit briefly closes the second switching device while the first switching device is open.

13. A method for controlling an electromagnetic injection valve, comprising:

during a first phase, charging a first magnetic coil by a first current and charging a second magnetic coil by a second current;

during a second phase, opening a second switching device to turn off the second current, wherein a first switching device passing the first current remains closed and the second phase being a valve opening phase;

during a third phase, activating a holding circuit causing the first current to drop to a holding current intensity, the third phase being a holding phase; and during a fourth phase, closing the electromagnetic injection valve by deactivating the holding circuit and opening the first switching device, the fourth phase being a closing phase.

14. The method of claim 13, further comprising:

setting the first current an the second current during the first phase based on a closing time of the first switching device and the second switching device.

15. The method of claim 13, further comprising:

setting a first current intensity passing through the first magnetic coil and a second current intensity passing through the second magnetic coil by regulating the first current and the second current during the first phase.

16. The method of claim 13, further comprising:

if the first current is turned off by the first switching device, increasing a current gradient by a first extinction device.

17. The method of claim 13, further comprising:

if the second current is turned off by the second switching device, increasing a current gradient by a second extinction device; and in response, accelerating the opening of the valve at the beginning of the second phase.

* * * * *